US007750272B2

(12) United States Patent
Furlanetto et al.

(10) Patent No.: US 7,750,272 B2
(45) Date of Patent: Jul. 6, 2010

(54) SLOW-COOKING METHOD AND OVEN

(75) Inventors: Riccardo Furlanetto, Venezia (IT); Francesco Maso, Treviso (IT)

(73) Assignee: Electrolux Professional SpA, Pordenone (IT)

( * ) Notice: Subject to any disclaimer, the term of this patent is extended or adjusted under 35 U.S.C. 154(b) by 0 days.

(21) Appl. No.: 11/535,123

(22) Filed: Sep. 26, 2006

(65) Prior Publication Data

US 2007/0068935 A1 Mar. 29, 2007

(30) Foreign Application Priority Data

Sep. 28, 2005 (IT) ..... PN2005A0067

(51) Int. Cl.
*A21B 1/40* (2006.01)
*A47J 37/00* (2006.01)

(52) U.S. Cl. ..... 219/413; 219/494; 99/333; 426/523

(58) Field of Classification Search ..... None
See application file for complete search history.

(56) References Cited

U.S. PATENT DOCUMENTS 3,003,048 A * 10/1961 Scott ..... 219/473
3,259,056 A * 7/1966 King ..... 99/325
4,458,140 A * 7/1984 Belinkoff ..... 219/497
4,815,439 A * 3/1989 Houck ..... 126/39 G
5,442,161 A * 8/1995 Matsushima ..... 219/756
5,672,291 A * 9/1997 Han ..... 219/753
5,973,300 A * 10/1999 Tomohiro ..... 219/497
7,080,593 B1 * 7/2006 Frankel ..... 99/326
7,128,466 B2 * 10/2006 Chang et al. ..... 374/141
7,279,659 B2 * 10/2007 Gages et al. ..... 219/400
2003/0007544 A1 * 1/2003 Chang et al. ..... 374/100
2004/0226454 A1 * 11/2004 Pirkle et al. ..... 99/331

FOREIGN PATENT DOCUMENTS

DE 2422632 A * 12/1975
EP 0 723 115 A2 7/1996

* cited by examiner

*Primary Examiner*—Joseph M Pelham
(74) *Attorney, Agent, or Firm*—Pearne & Gordon LLP

(57) ABSTRACT

Method for cooking food, to be performed in an oven with a cooking cavity, a core-temperature proble capable of being introduced in a food item placed in the cooking cavity and provided with a temperature sensor for the food temperature and a sensor for detecting the temperature within the oven cavity, wherein these sensors are adapted to generate and output respective signals, control means being provided, which are adapted to receive and process such signals issued by said temperature sensors and to supply corresponding operating commands to heating means associated to the oven; there are provided setting means adapted to define a selectively modifiable value of a final reference temperature. After an initial heating period and a subsequent cooling-down step, during which the temperature inside the oven cavity anyhow remains at a higher value than said final reference temperature, said control means, on the basis of the signals received from said sensors, start and run an operating phase in such manner as to enable a temperature to be obtained and persistingly ensured within the oven cavity, whose difference as compared with said final reference temperature is a function of the difference between said final reference temperature and the temperature detected by the temperature sensor at the core of the food.

12 Claims, 4 Drawing Sheets

SLOW-COOKING METHOD AND OVEN

The present invention refers to an improved kind of a food cooking oven, in particular for professional kitchen and mass catering applications, which is provided with such performance and operation features as to enable it to obtain significant advantages as far as the quality of the cooking process and the related results is concerned, along with a significant reduction in energy usage.

Throughout the following description, reference will be made to food cooking ovens of a general kind, since the present invention applies to ovens in which the heating means are independent of the type of energy used, which may in fact be electricity or gas; however, it should be specially noticed that, while these ovens may also be provided with a microwave cooking capability, the method according to the present invention does not apply when cooking is performed by using such cooking mode.

It is a widely known fact that in food cooking ovens use is typically made of special probes adapted to sense the temperature being reached at the core of the food being cooked, and to output corresponding signals that are used to control the cooking process.

This circumstance is of particular value when large and compact masses of food—i.e. large pieces of meat, practically—are being cooked, the core temperature of which needs to be particularly monitored in view of determining the most favourable moment at which the cooking process has to be suitably brought to an end. Anyway, it should be noticed that such feature proves particularly convenient and practical even when smaller pieces of meat are cooked, actually, provided that these smaller pieces are first caused to undergo a short surface roasting operation, followed by traditional cooking in an oven.

In fact, when large volumes of meat are cooked there may occur—and usually occur, actually—following drawbacks:

- surface scorching/burning effects, due to the fact that, for the temperature at the core of a piece of meat to be brought up to and held at the value needed for an optimum cooking effect, which is generally situated within a range from 50 to 80° C., for at least ten minutes or so, the need arises for the temperature outside the meat, i.e. the temperature within the oven cavity, to be brought up to a value of at least 120 to 150° C. and be held there for at least 30 minutes, depending on the kind of meat being handled and the cooking degree to be reached; this of course causes the outermost layers of the meat to be exposed to overheating and, as a result, an overcooking effect. At the end of the cooking process, it is therefore desirable, or even necessary, for any excessively cooked, i.e. scorched or burned portions of the meat to be removed, since they would otherwise prove quite unappealing. On the other hand, this fact is largely known in the art, so that no need arises here to dwell upon it any longer;
- loss of water and other internal substances from the food being cooked; holding an elevated temperature inside the mass of the meat being cooked furthermore causes water and juices existing inside such mass to drain, thereby bringing about a kind of migration of the liquids from inside the same mass towards the outside, where they eventually evaporate, in a continuous process until practically the end of the cooking process itself. The ultimate result is that—after cooking—the inner parts of the mass turn out as being tough and dry to some varying extent, which means a deterioration in the organoleptic quality of the food itself;
- excessive energy usage; it can in fact be readily appreciated that reaching and holding elevated temperatures inside the cooking cavity of the oven requires a significant amount of energy to be used, owing also to the heat losses from the interior of the oven towards the outside ambient, which—although kept in check to some extent by the normally provided heat insulation of the oven—should anyway desirably be reduced to a minimum without incurring overcharges and other problems generally induced by or associated with a possible increase in heat insulation thickness or efficiency.

These drawbacks are further aggravated by a constraint induced by the meat being customarily—or intentionally—allowed to undergo tenderizing, i.e. to become high naturally, which is a process requiring the mass of meat to be left at rest—before actual cooking—for a period of time that varies depending on the particular animal species which the meat is derived from, and this constraint puts a heavy penalty, especially when there is a need for large masses of meat to be cooked within relatively short a time just as they become available from the butchery.

A cooking process is known, for example from the disclosure in EP 0 723 115 B1 granted to V-Zug AG, in which the core temperature in a food being cooked is controlled so as to allow it to follow a pre-defined increasing trend versus the time elapsing from the beginning of the cooking cycle, and in which the temperature in the cooking cavity is gradually increased so as to cause the temperature inside the food to follow that pre-defined increasing trend.

Such process, although effective in enabling the temperature within the food to increase in a gradual and non-shocking manner, is however not able to fully solve the problem due to the inner portions of the food drying up progressively, since the temperature in the cooking cavity, after a phase in which it increases to a high initial value and subsequently decreases to a lower one, increases again so as to be able to "guide" the temperature increase inside the food in a rigid manner.

Basically, this process is to some extent independent of the temperature being reached inside the food and such circumstance practically implies that the cooking process takes neither the mass nor the quality, i.e. the characteristics of the food being handles into due account, actually, and this does of course not fail to affect and limit the final cooking results obtainable therefrom.

In addition, this cooking process appears to be quite quick to be completed (as stated in particular in claim 5 of the above-cited patent, the process has a duration comprised between 3.5 and 4.5 hours).

The ultimate consequence of this on the cooked product is a reduction in the tenderness thereof, which on the contrary tends to increase to a measurable extent when the cooking time is made longer under a more gradual increase of the core temperature, so as to allow the internal fibres to undergo a kind of gelatinization process brought about in this manner.

It would therefore be desirable, and is a main object of the present invention, to provide a fabric cleaning apparatus, which is effective in doing away with the above-noted drawbacks of the cited prior art.

Within this general object, it is a further purpose of the present invention to provide a cooking method and a cooking oven provided with means that are adapted to automatically regulate and govern the temperature in the cooking cavity as an inverse function of the instant temperature at the core of the food, so that the amount of thermal energy, i.e. heat, delivered to the food is automatically reduced as cooking goes on and the temperature at the core of the food approaches its final value.

According to the present invention, these aims, along with further ones that will become apparent from the following disclosure, are reached in a cooking method and a cooking oven incorporating the features as defined and recited in the claims appended hereto.

Features and advantages of the present invention will anyway be more readily understood from the description that is given below by way of non-limiting example with reference to the accompanying drawings, in which.

Figure 1:
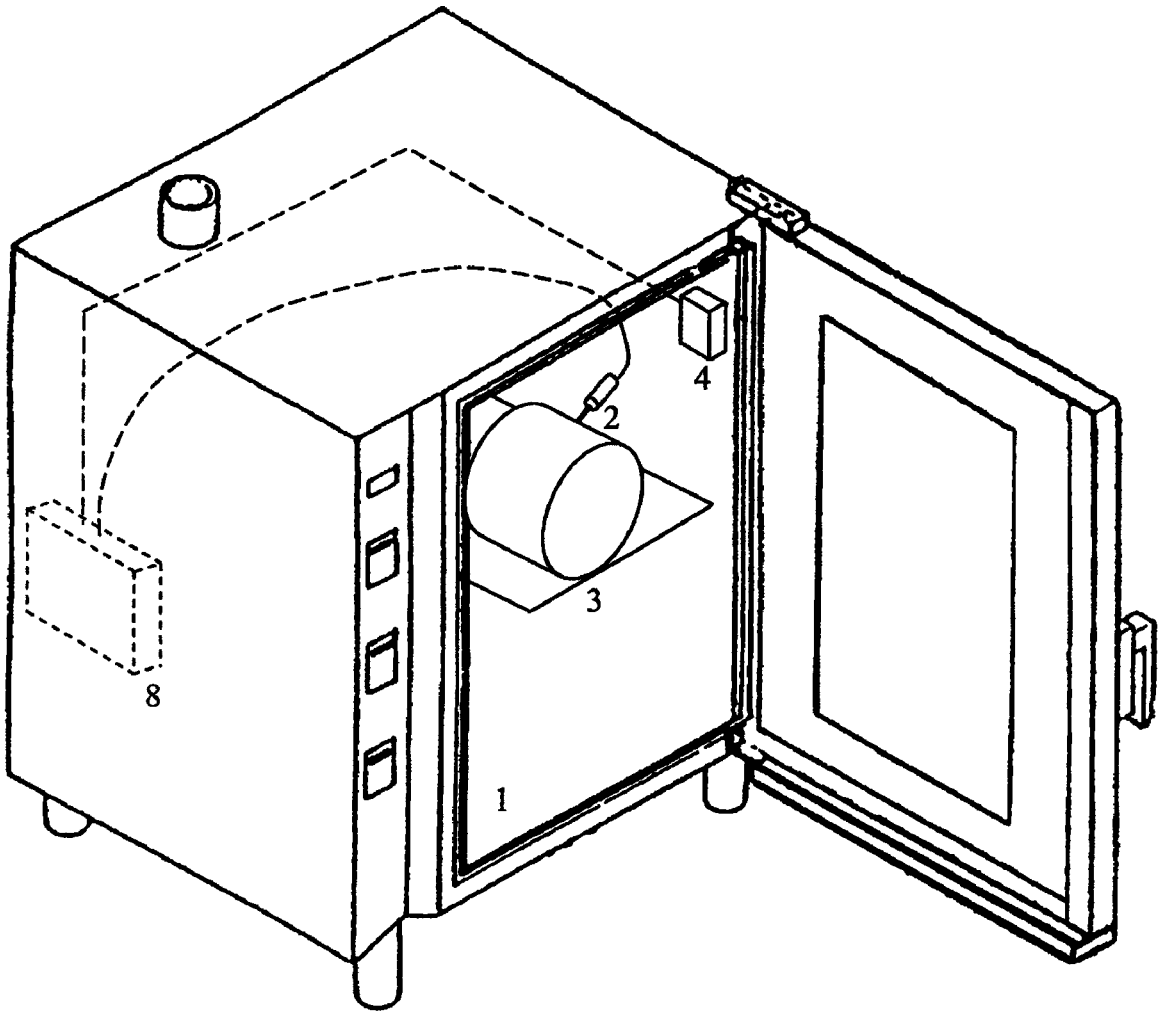
FIG. 1 is a perspective front view of a cooking oven of a generally known kind, provided with a so-called core-temperature probe adapted to sense and detect the temperature inside the food.

With reference to FIG. 1, use is made of an oven of a generally known kind, provided with a cooking cavity 1 and two independent temperature sensors, wherein a first sensor 2 is provided in a needle-like core temperature probe adapted to be introduced in the mass 3 of the food to be cooked, and a second sensor 4 is arranged so as to be able to detect the temperature prevailing inside said cooking cavity 1.

Such two sensors 2 and 4 are connected to a storage, processing and control unit 8, shown symbolically in the Figure, the operation of which includes processing the signals generated by said two sensors, as well as transmitting the thus processed-out data to means of a generally known kind (not shown) adapted to heat up the interior of the cooking cavity.

In addition, this oven is also provided with external selection means that are adapted to allow the user to enter appropriate settings and adjustments, which, as selectively controllable from the outside, are adapted to interact with said storage, processing and control unit in the signal processing operation thereof.

At this point, it should be specially pointed out that the construction of the above-cited oven is absolutely similar to, i.e. does by no means depart from the typical construction of traditional prior-art ovens, and that the present invention solely refers to the mode in which the inventive oven is caused to operate under the control of said storage, processing and control means, as described below.

Figure 2:
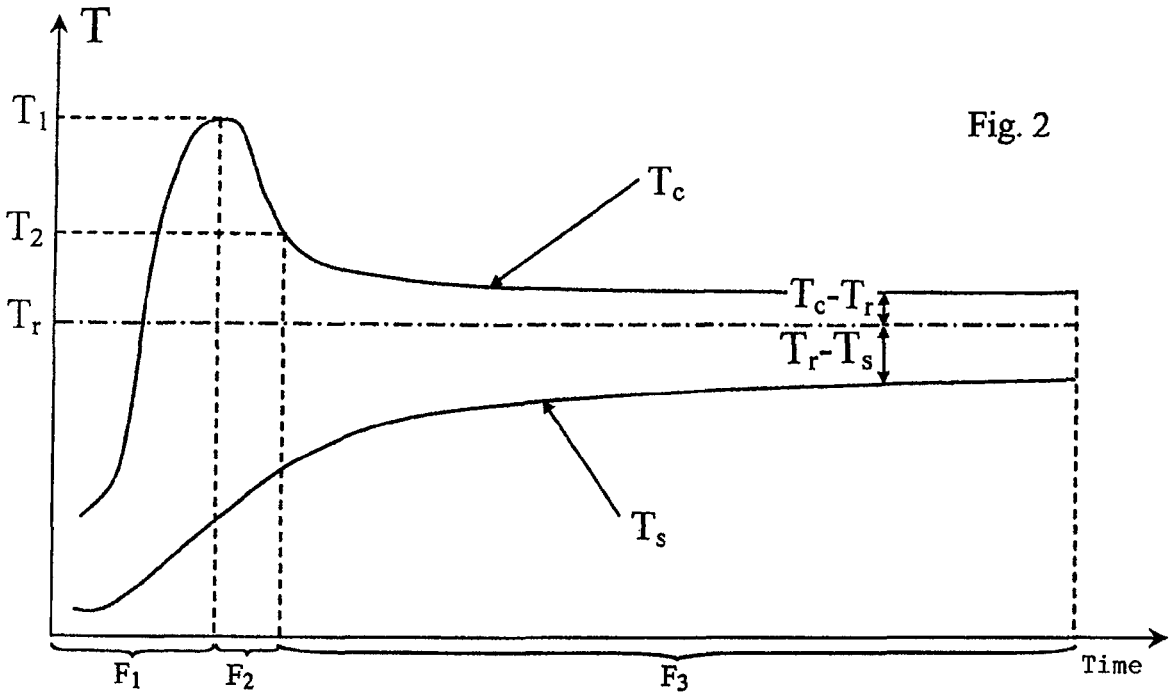
FIG. 2 is a graph representing the trend of the temperatures detected by respective sensors in an oven and during a cooking method according to the present invention.

With reference to FIG. 2, shown in the same diagrammatical representation there are two distinct curves representing the instant trend of respective temperatures being detected by said two sensors 2 and 4. Namely, the temperature being detected by the sensor 2 is indicated at $T_s$, while the temperature detected by the sensor 4 is indicated at $T_c$.

The cooking method according to the present invention starts with a process step F1, in which the temperature $T_c$, within the cooking cavity is brought up to a value $T_1$, which is sensibly higher than the temperature value $T_r$ corresponding to the final temperature that the food is required to reach at the core thereof for the cooking process to be able to be considered as ended. As already hinted hereinbefore, this final temperature, which shall be referred to as the final reference temperature $T_r$ hereinafter, usually lies at approximately 60° C.; this value is however capable of being modified through appropriate user-operable selection means, whose settings are transmitted to said storage, processing and control means.

Subsequently, in a second process step F2, the temperature $T_c$, in the cooking cavity is decreased at a quick rate down to a value $T_2$, wherein this may for instance be accomplished by means of an intensive ventilation of the oven cavity with air from the outside ambient, while of course having the heating means concurrently switched or turned off.

Such temperature value $T_2$ may be determined in a variety of manners or can be pre-defined selectively; it is however a preferred option when such value is biunivocally connected with the value of the final reference temperature $T_r$, so that it just takes to solely select such quantity to automatically determine—with optimum final results—also said temperature $T_2$.

During the above-cited process steps, the temperature $T_s$ inside the food being cooked increases in a continuous manner, even if the cavity heating means are switched or turned off, owing to the thermal inertia of the mass of the same food or, in other words, owing to the heat absorbed by the food during the first step F1 tending then to transfer from the outer layers to the inner layers thereof.

Thereafter, the method goes on by starting the most important process step F3. In this step, the temperature $T_c$ within the cooking cavity of the oven is adjusted continuatively and with such an instant amplitude as to ensure that the temperature difference $T_c-T_r$ (relative to said final reference temperature $T_r$) varies according to a definite decreasing function $$F(T_r,T_s)$$

as the difference $T_r-T_s$ between said final reference temperature $T_r$ and the temperature $T_s$ detected by the first sensor 2 introduced in the food being cooked decreases.

In this way, since the temperature $T_s$ is increasing gradually owing to said thermal inertia of the food mass, and therefore is approaching said constant value $T_r$, even the temperature in the oven cavity $T_c$ must decrease in view of complying with the above-defined function F.

In the course of exhaustive experiments and comparative investigations, it has in fact been found that such situation is particularly favourable in view of obtaining a kind of cooking action, which is both progressive and delicate, according to the actual aims pursued by the present invention.

As a matter of fact, the food being cooked triggers a heat, i.e. thermal energy demand for cooking that depends on the amount of thermal energy that is actually needed for the portion of the cooking method that has still to be carried out to complete the process.

It is therefore as if it were the food itself or, still better, the instant temperature reached at the core thereof, that automatically regulate the delivery of thermal energy as just actually needed for cooking, thereby avoiding unnecessary or even harmful overtemperatures, and rigidly fixed cooking times that do not take such factors as the characteristics and the mass of the food into due account, since the temperature $T_s$ measured inside the food is of course fully inclusive of the combined effect of said two factors.

It has also been found that the inventive cooking method, owing to its including said initial process step F1 conducted at a high temperature for rather short a time, enables the well-known searing effect to be anyway obtained, which practically cauterizes and seals the outer surface of the mass of the meat being cooked, while the short duration of the same step is effective in preventing the same mass from heating up to any excessive extent internally.

The combined effect of an adequate cooking action and a surface scorching effect is therefore obtained in this way, thereby preventing—among other things—water, juices and other internal substances of the food from escaping through the outer surface of the mass of the meat, while keeping—inside said mass—a sufficiently low temperature as to effectively prevent the food from drying up and losing its best and desirable liquid substances.

This also enables an effect of a quite significant economic purport to be obtained: in fact, while the weight losses suffered by a large mass of meat submitted to a cooking process of a traditional kind, due exactly to the loss of water and liquids, usually range between 28% and 40%, a weight loss of just approx. 10% could be observed for the inventive method.

Figure 3:
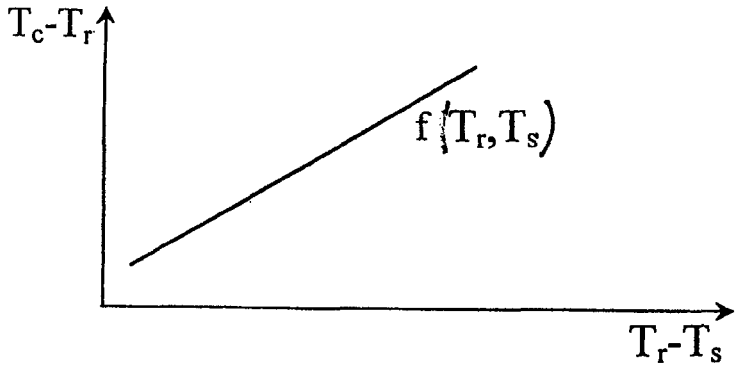
FIG. 3 is a graph representing the trend in the difference between two temperatures, as detected by two respective sensors, and a common value.

The inventive cooking method itself may be embodied in a still more advantageous manner if said function $F(T_r, T_s)$ is simply converted into a linear function, in which said temperatures $T_c$ and $T_s$ are substantially proportional, with a known and—again—selectively pre-determinable proportionality constant, as illustrated schematically in FIG. 3.

Figure 4:
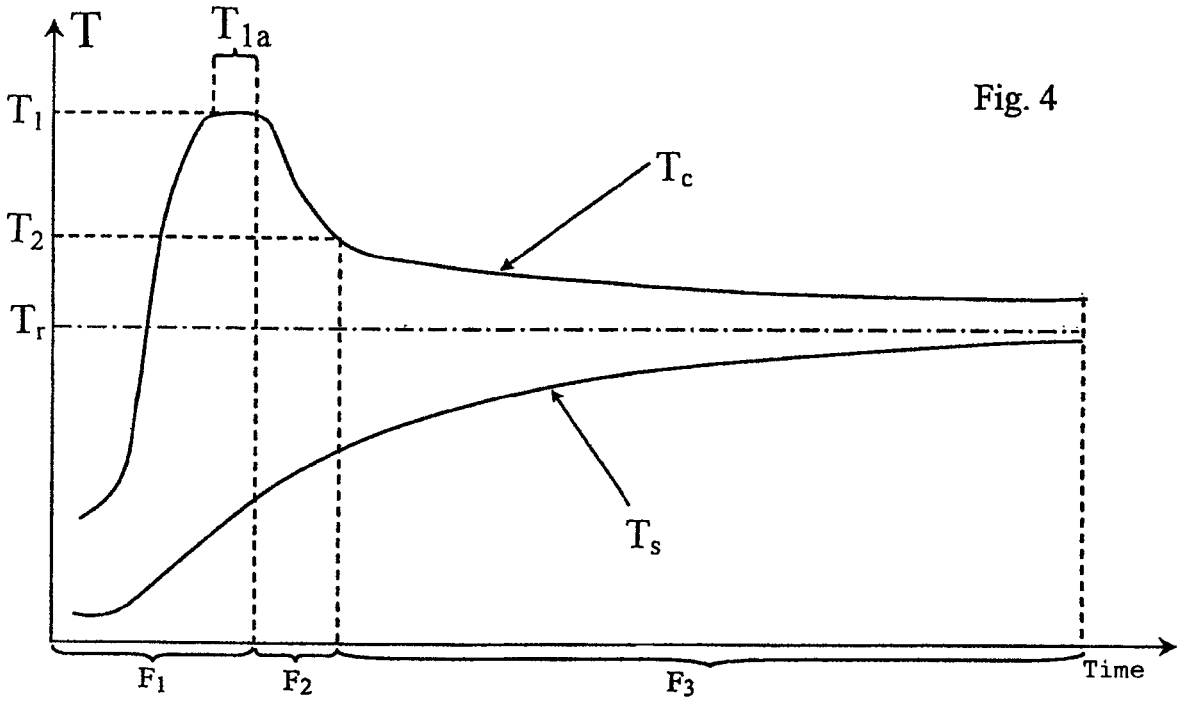
FIGS. 4 and 5 are respective graphical representations of temperature trends similar to those shown in FIG. 2, however with two respective improved embodiments of the cooking method according to the present invention.

With reference to FIG. 4, an ameliorative effect has also been noticed when said process step F1 is designed to also include, upon reaching said highest temperature $T_1$ and prior to subsequently allowing it to decrease, a dwelling at such temperature $T_1$ for a short pre-definable period of time $T_{1a}$, wherein this time should not be shorter than approx. 10 minutes and the dwelling temperature should preferably lie slightly above 120° C., so as to more effectively and reliable determine such searing, i.e. "sealing" of the outer surface of the mass of the meat being cooked.

At this point, the way in which the inventive cooking method operates is therefore fully apparent: upon performing and completing the process steps F1, $T_{1a}$ and F2, which are time-programmable and/or temperature-programmable steps through said storage, processing and control means in manners that are largely known as such in the art, the next process step F3 is activated by means of one or several instructions, in which:

- a measurement is in the first place made of the temperature $T_s$;
- the difference between this temperature and the value of the final reference temperature $T_r$—residing in said storage, processing and control means—is then calculated;
- subsequently, or concurrently, the measurement is performed of the temperature $T_c$;
- then, the difference between said same value of $T_r$ and the temperature $T_c$ is measured;
- said two temperature differences are compared with each other in accordance with said function $F(T_r, T_s)$; and
- the related deviations are finally detected, processed and used to appropriately control the operation of the heating means of the oven, i.e. to switch or turn them on and off accordingly, in such a manner as to ensure that said function $F(T_r, T_s)$ is verified continuously.

The above-cited value of the final reference temperature $T_r$ may of course be determined and entered by the user using largely known manners for setting and regulating process parameters, although the temperature value that is generally accepted as being the optimal one in this connection lies anyway within a range from 57° C. to 80° C.

The above-cited processing and control procedure may be carried out at pre-established intervals; however, the processing and control means that are currently known and available in the art allow temperature values to be sampled, the related data to be processed and the corresponding commands to be delivered even at frequencies as high as several thousands of cycles per second and, anyway, with periods that are enormously shorter than the duration of the cooking process, so that the regulation of the temperature $T_c$ inside the cooking cavity may be considered as occurring in a substantially continuous manner.

The cooking process must of course come to an end and, according to the inventive method, this occurs when the difference $T_r - T_s$ between said final reference temperature $T_r$ and the temperature $T_s$ detected by the first sensor 2 at the core of the food being cooked becomes smaller than a pre-established value $V_p$ that can of course be stored in said storage, processing and control means of the oven.

In this connection, a particular circumstance has been found to take place at this point. In fact, if the temperature $T_c$ inside the cooking cavity continues to be held at the last reached value after the above-illustrated end-of-cooking condition has been reached, and if the same temperature is held at such value for an extended period of time, e.g. a few hours, the meat—as all those skilled in the art are largely aware of—starts to give off unpleasant or—especially with some kinds of meat and fat—even intolerable odours.

Such occurrence is largely known to be due to fermentation and protein degradation processes of various kinds taking place in the meat.

In addition, such occurrence is not solely limited to the period of time in which the food in the oven is further held at cooking temperature after the cooking process itself has practically come to an end, which should occur at the end of the process step F3, but goes on even during the so-called "maturation" period, i.e. within the same step F3, as clearly due to the considerably long duration of said step, which is usually much longer than the duration of a corresponding cooking process according to prior-art methods.

It would therefore be necessary for the meat to be readily removed from the oven and eaten after cooking, without waiting any too long a time.

It has however been noticed that, if the temperature inside the oven cavity is held under the afore-described conditions and a forced ventilation of the same cavity is carried out periodically to replace, i.e. change the air therein, e.g. with the use of an appropriate fan which the oven should anyway be provided with, while restoring each time the oven cavity temperature at said last value thereof, the meat does no longer take or give off the typical, unpleasant aspect and odours of a food under fermentation, but rather maintains its initial characteristics, i.e. the characteristics it has assumed at the end of the actual cooking process, and—in particular—no unpleasant odour emission is sensed.

Figure 5:
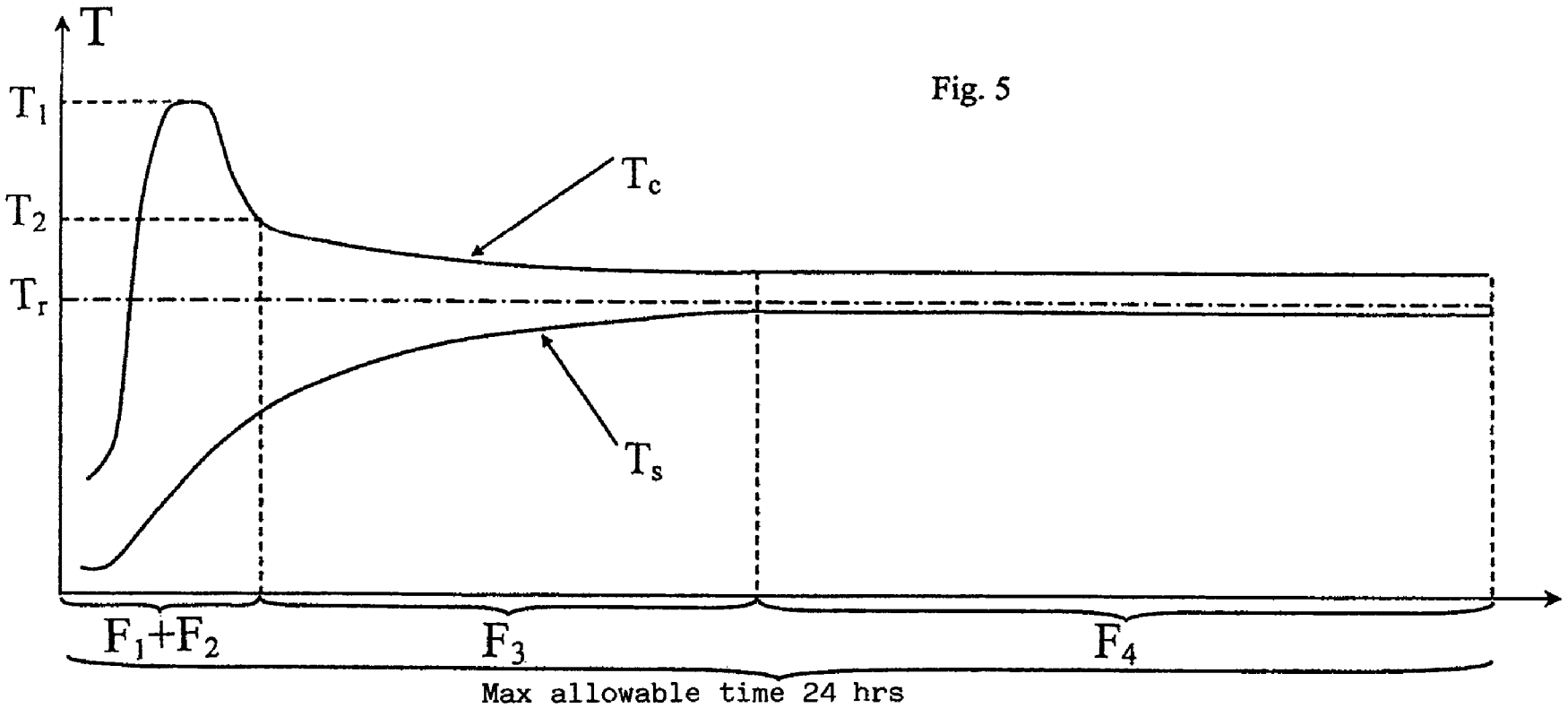

With reference to FIG. 5, such condition arises when the food is kept at the above-noted temperature within a period of time of max. 24 hours from the beginning of the complete cooking cycle, i.e. from the beginning of the afore-cited process step F1.

It is therefore advantageous if the inventive cooking method, and the oven adapted to carry out such method, is designed to include an additional operating mode, according to which—both during the afore-cited maturation step F3 and after the temperature due to be reached at the end of the same step F3 is eventually attained—cooking is allowed to continue through a further process step F4, in which the temperature $T_c$ in the cooking cavity is held at the last reached value, or even at a lower and anyway pre-definable value, for such a length of time as to ensure that the maximum duration of the cooking cycle from the beginning thereof, and therefore from the beginning of the step F1 until the end of said further step F4, does not exceed 24 hours.

During said steps F3 and F4, the cooking cavity of the oven must be ventilated in a systematic manner, which means in a way that has not necessarily to be continuous, but rather by having the fan used to circulate the air inside the cavity operated periodically, along with the opening and closing of the related access door from outside and exhaust ports to the outside, e.g. in a pulsed mode as this is largely known as such in the art.

The invention claimed is:

1. Food cooking method to be carried out in a cooking oven, comprising:

a cooking cavity (1), which can be acceded to from the outside through a door, heating means adapted to heat up the interior of said cooking cavity, a first sensor (2) applied on to a movable core-temperature probe that is adapted to be inserted in a food (3) placed inside said cooking cavity, and is provided with at least a temperature sensor adapted to measure the temperature ($T_s$) at the core of said food, a second temperature sensor (4) adapted to measure the temperature ($T_c$) prevailing inside said cooking cavity, wherein said temperature sensors (2, 4) are adapted to generate and output respective signals that are representative of the temperatures detected by them, storage, processing and control means (8) adapted to process the signals output by said temperature sensors and deliver appropriate operating commands to said heating means, accordingly, setting and regulating means adapted to define the selectively modifiable value of a final reference temperature ($T_r$), wherein said storage, processing and control means (8) are adapted to receive and process said temperature signals being output by said sensors, and to control a specific step (F3) of operation of said heating means so as to obtain in a continuative manner, inside the cooking cavity, a respective internal temperature ($T_c$), the difference ($T_c-T_r$) of which from the value of said final reference temperature ($T_r$) is a function ($F(T_r, T_s)$) of the difference ($T_r-T_s$) between said final reference temperature ($T_r$) and the temperature ($T_s$) detected by said sensor (2) introduced in the food, during said specific step (F3) said cooking cavity being periodically ventilated with air circulated from outside, so as to change the air therein, while restoring each time said cooking cavity temperature at the last value of the temperature sensed prior to ventilation.

2. Method according to claim 1, wherein said specific operating step (F3) is performed after a pre-determined cycle of operation of said oven.

3. Method according to claim 2, wherein said pre-determined cycle of operation of the oven includes a first process step (F1), in which the temperature ($T_c$) within said cooking cavity is brought up to a first selectively pre-determinable value ($T_1$) that is sensibly higher than the value of said final reference temperature ($T_r$), and a subsequent process step (F2), in which said temperature ($T_c$) within the cooking cavity is pulled down to a second value ($T_2$) lying still above said final reference temperature ($T_r$).

4. Method according to claim 3, wherein said second temperature value ($T_2$) is biuniquely determined by the value of said final reference temperature ($T_r$).

5. Method according to claim 3 or 4, wherein when the temperature inside said cooking cavity in said first process step (F1) reaches up to said first value ($T_1$), this temperature value is held through an intermediate period ($T_{1a}$).

6. Method according to claim 5, wherein said intermediate period ($T_{1a}$) has a duration of at least 10 minutes.

7. Method according to claim 5, wherein during said intermediate period ($T_{1a}$), the temperature ($T_c$) inside said cooking cavity is held at a value above 120° C.

8. Method according to claim 1, wherein said specific process step (F3) is ended when the difference ($T_r-T_s$) between said final reference temperature ($T_r$) and the temperature ($T_s$) detected by the first sensor (2) becomes smaller than a pre-set value ($V_p$).

9. Method according to claim 8, wherein said storage, processing and control means are adapted to automatically cause the oven to operate through a further process step (F4) following the end of said specific step (F3), so that the overall duration of the cooking cycle including said first step (F1), said second step (F2), said specific step (F3) and said further step (F4) is extended for a period of time that is selectively pre-definable within a maximum allowable time.

10. Method according to claim 9, wherein during said further step (F4) said cooking cavity is periodically ventilated with air circulated from outside, so as to change the air therein, while restoring each time said cooking cavity temperature at the last value thereof.

11. Method according to claim 10, wherein said maximum allowable time is limited to 24 hours.

12. Method according to any one of the claims 8 to 11 and 10, wherein after the end of said specific process step (F3), said temperature ($T_c$) within said cooking cavity is held at the last detected value thereof, or at a different, but constant and selectively pre-definable value.

* * * * *